US008459019B2

(12) United States Patent
Hohensee

(10) Patent No.: US 8,459,019 B2
(45) Date of Patent: Jun. 11, 2013

(54) SYSTEM AND METHOD FOR PILOT-OPERATED HIGH PRESSURE VALVE

(75) Inventor: Paul A. Hohensee, Germantown, WI (US)

(73) Assignee: Actuant Corporation, Menomonee Falls, WI (US)

( * ) Notice: Subject to any disclaimer, the term of this patent is extended or adjusted under 35 U.S.C. 154(b) by 815 days.

(21) Appl. No.: 12/446,613

(22) PCT Filed: Oct. 30, 2007

(86) PCT No.: PCT/US2007/082983

§ 371 (c)(1), (2), (4) Date: Jan. 7, 2010

(87) PCT Pub. No.: WO2008/055147

PCT Pub. Date: May 8, 2008

(65) Prior Publication Data

US 2010/0107622 A1 May 6, 2010

Related U.S. Application Data

(60) Provisional application No. 60/863,658, filed on Oct. 31, 2006.

(51) Int. Cl.
*F16D 31/02* (2006.01)
*F15B 13/044* (2006.01)

(52) U.S. Cl.
USPC ..... 60/430; 60/486; 91/459; 91/461

(58) Field of Classification Search
USPC ..... 60/421, 423, 428, 430, 486; 91/459, 91/461
See application file for complete search history.

(56) References Cited

U.S. PATENT DOCUMENTS

| | | | |
|---|---|---|---|
| 4,184,331 | A | 1/1980 | Bentley |
| 4,833,971 | A | 5/1989 | Kubik |
| 6,916,158 | B2 | 7/2005 | Bishop |

OTHER PUBLICATIONS

International Search Report and Written Opinion as mailed on Jul. 15, 2008 for International Patent Application PCT/US2007/082983.

*Primary Examiner* — Michael Leslie
(74) *Attorney, Agent, or Firm* — Quarles & Brady

(57) ABSTRACT

A system and method for operating a two-stage, high-pressure pumping system includes a low-pressure pump having an output configured to deliver a hydraulic fluid under a low-pressure at a high-volume to drive a tool associated with the two-stage, high-pressure, pumping system under low load conditions. The system also includes a high-pressure pump having an output configured to deliver the hydraulic fluid under a high-pressure at a low-volume to drive the tool under high load conditions. A pilot-operated device is included that is configured to selectively drive the tool with pressure from at least one of the output of the low-pressure pump and the output of the high-pressure pump. The pilot-operated device receives pilot pressure from the output of the low-pressure pump to control selectively driving the tool with the output of the two stage pump.

12 Claims, 2 Drawing Sheets

SYSTEM AND METHOD FOR PILOT-OPERATED HIGH PRESSURE VALVE

CROSS REFERENCE TO RELATED APPLICATIONS

This application claims priority to U.S. Provisional Application No. 60/863,658, filed Oct. 31, 2006, the entirety of which is hereby incorporated by reference herein.

FIELD OF THE INVENTION

This invention relates to hydraulically driven tool systems. In particular, the present invention relates to a system and method for a pilot-operated, high-pressure control system. For example, the pilot-operated, high-pressure control system may be configured to control the output of a high-pressure pump system driving a piston-driven hydraulic tool.

DISCUSSION OF THE PRIOR ART

Pilot-operated valve technology has been used in low- and mid-pressure hydraulic fluid power applications for decades. In each case, these hydraulic applications typically operate at pressures of 1,000 to 5,000 pounds per square inch (psi). Typically, pilot-operated devices are used to actuate pressure-relief valves, variable-displacement pumps, and directional-control valves. By using a pilot-operated device, the force delivered to the control element can be much higher than could be developed by typical springs, solenoids, or other such force generators.

In general, pilot-operated devices use a small amount of hydraulic power from the main system to operate a control circuit that, in turn, is used to control a valve or other control element. Pilot-operated devices are used extensively in low-pressure and some mid-pressure, fluid-power applications because there is generally plenty of flow available to operate both the pilot device and the device being driven by the hydraulic power. For example, when operating a proportional directional control valve, these pilot devices typically consume around 0.5 to 1.0 liter of fluid per minute under standard operation.

In the field of high pressure hydraulic tools, which have typical operating pressures of 10,000 psi or higher, the extremely high operating pressures require highly specialized design and quality control constraints. For example, high-pressure pumps and valves designed to operate at these pressures have relatively simple flow paths that are adapted to accommodate a low hydraulic flow (e.g., approximately 1 liter per minute) at full pressure.

To facilitate rapid tool movement when unloaded, many pump systems include a two-stage design. The two-stage design includes a first-stage pump designed to provide a high flow rate at a low pressure. In this regard, the first-stage can rapidly advance the tool under a minimal load. The second-stage pump is designed to provide a relatively low flow rate at very high pressure to drive the tool at a reduced speed, but with an extremely high force.

Therefore, when initially experiencing a minimal load, the tool is driven by the first-stage pump. When the tool later encounters an increased load, the pump system shifts to the second-stage pump to provide a high-pressure, low-flow output that is capable of driving the tool to its maximum output. While operating under the second-stage pump, the flow from the first-stage pump is typically "unloaded" to a tank at a very low pressure to reduce horsepower consumption.

In high-pressure applications operating under pressures of 10,000 psi or more, a two-stage pump operating under the second-stage pump will produce flow rates of approximately 1.0 liter per minute. As such, traditional pilot-operated devices are not used to control operation of high-pressure, two-stage pump systems because the pilot operated device would add complexity to the system that could result in a failure under high-pressure operation and, more importantly, the pilot-operated device would consume the nearly entire output from the second-stage pump. That is, when maximum output is required, the second-stage pump would fail to drive the tool because the pilot section of the pilot-operated device would consume the majority of the flow output from the second-stage pump.

As such, traditional two-stage, high-pressure hydraulic systems rely on manually actuated controls to switch the output between the first-stage pump and the second-stage pump. Since these systems rely on manual force to engage or disengage a control, the force applied to the control and the response of the control to actuation is significantly limited.

Therefore, it would be desirable to have a system and method to automatically actuate a hydraulic control, such as a pressure relief valve, a variable displacement pump, and a directional control valve, without the need to rely on manual force as the power to drive actuation.

SUMMARY OF THE INVENTION

The present invention overcomes the aforementioned drawbacks by providing a system and method for a pilot-operated, control system for a high-pressure pumping system. The pilot-operated control system may be configured to selectively couple a hydraulic tool driven by a two-stage pump system to one of a first, low-pressure pump and a second, high-pressure pump to drive the tool over a dynamic operating range.

In accordance with one embodiment, a two-stage, high-pressure, pumping system is disclosed that includes a low-pressure pump having an output configured to deliver a hydraulic fluid under a low-pressure at a high-volume to drive a tool associated with the two-stage, high-pressure, pumping system under low load conditions. The system also includes a high-pressure pump having an output configured to deliver the hydraulic fluid under a high-pressure at a low-volume to drive the tool under high load conditions. Furthermore, the system includes a pilot-operated device configured to selectively drive the tool from at least one of the output of the low-pressure pump and the output of the high-pressure pump. The pilot-operated device includes at least one pilot port that is pressurized by a pilot pressure to actuate the pilot-operated device. Accordingly, the pilot pressure to actuate the pilot-operated device is provided by the output of the low-pressure pump to control selectively driving the tool from one of the output of the low-pressure pump and the output of the high-pressure pump.

In accordance with another aspect of the invention, a method for operating a two-stage, high-pressure, pumping system is disclosed that includes driving a hydraulic tool under a low-load condition using a low-pressure pump having an output configured to deliver a hydraulic fluid under a low-pressure at a high-volume. The method also includes driving the tool under high-load conditions using a high-pressure pump having an output configured to deliver the hydraulic fluid under a high-pressure at a low-volume. Furthermore, the method includes controlling a pilot-operated device using the output of the low-pressure pump to actuate the device to selectively operate the tool.

In accordance with yet another aspect of the invention, a kit for retrofitting a two-stage, high-pressure, pumping system is disclosed that includes a low-pressure pump having an output configured to deliver a hydraulic fluid under a low-pressure at a high-volume to drive a tool associated with the two-stage, high-pressure, pumping system. The system also includes a high-pressure pump having an output configured to deliver the hydraulic fluid under a high-pressure at a low-volume to drive the tool. The kit includes a driving connection input configured to connect to the output of the low-pressure pump and a pressure reducing valve configured to receive the flow of hydraulic fluid from the driving connection input and reduce a pressure of the hydraulic fluid received from the low-pressure pump through the driving connection input. A pilot-operated device is included in the kit that is configured to receive the flow of hydraulic fluid from the pressure reducing valve at the pressure below the low pressure and utilize the flow of hydraulic fluid to actuate the pilot operated device so to control the tool.

Various other features of the present invention will be made apparent from the following detailed description and the drawings.

DETAILED DESCRIPTION OF THE PREFERRED EMBODIMENT

Figure 1:
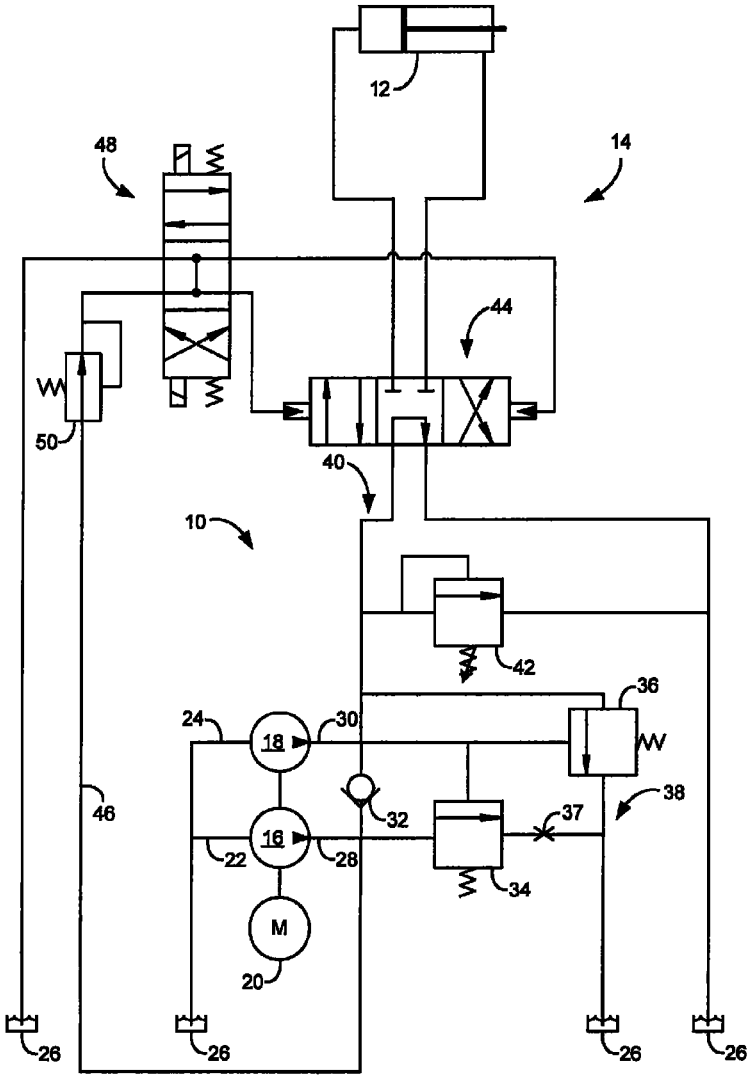
FIG. 1 is a schematic diagram of a two-stage pump system configured to drive an associated hydraulic tool over a range of operating modes and a pilot-operated control system configured to control delivery of hydraulic fluid from the two-stage pump system to the hydraulic tool.

Referring to FIG. 1, a two-stage pump system 10 is coupled to drive a hydraulic tool 12. As will be described, a pilot-operated control system 14 is coupled between the two-stage pump system 10 and the hydraulic tool 12 to control delivery of driving hydraulic fluid from the two-stage pump system 10 to the tool 12.

The hydraulic tool 12 is a "high-pressure" hydraulic tool, such as a hydraulic lift. For purposes of this application, the term "high pressure" will refer to pressures at or in excess of approximately 5,000 pounds per square inch (psi). While the high-pressure tool 12 is configured to be driven by a supply of hydraulic fluid at or in excess of 10,000 psi, such high-pressure hydraulic tools 12 are typically designed to be driven from a high-pressure supply during periods of high or full load. In this regard, during periods of operation under low or reduced load, the high-pressure hydraulic tool 12 is designed to be driven from a "low-pressure" supply. For purposes of this application, the term "low-pressure will refer to pressures below 3,000 psi. For example, high-pressure tools 12 such as hydraulic lifts are configured to be driven by maximum low-pressure supplies of approximately 1,700 psi.

The two-stage pump system 10 includes a low-pressure pump 16 and a high-pressure pump 18 driven by a motor 20. While FIG. 1 shows that the low-pressure pump 16 and the high-pressure pump 18 are driven by a common motor 20, it is contemplated that the low-pressure pump 16 and the high-pressure pump 18 may be driven by separate motors.

As defined above, the low-pressure pump 16 and the high-pressure pump 18 operate to deliver fluid under "low pressure" and "high pressure", respectively. Furthermore, beyond being designed to deliver fluid under low pressure, the low-pressure pump 16 delivers a "high-volume" of fluid. For purposes of this application, the term "high volume" will refer to volumes delivered at a rate of greater than approximately 5 liters per minute, for example, between 6 and 20 liters per minute. Additionally, the high pressure pump 18 delivers a low-volume of fluid. For purposes of this application, the term "low volume" will refer to volumes delivered at a rate of less than 3 liters per minute.

Figure 2:
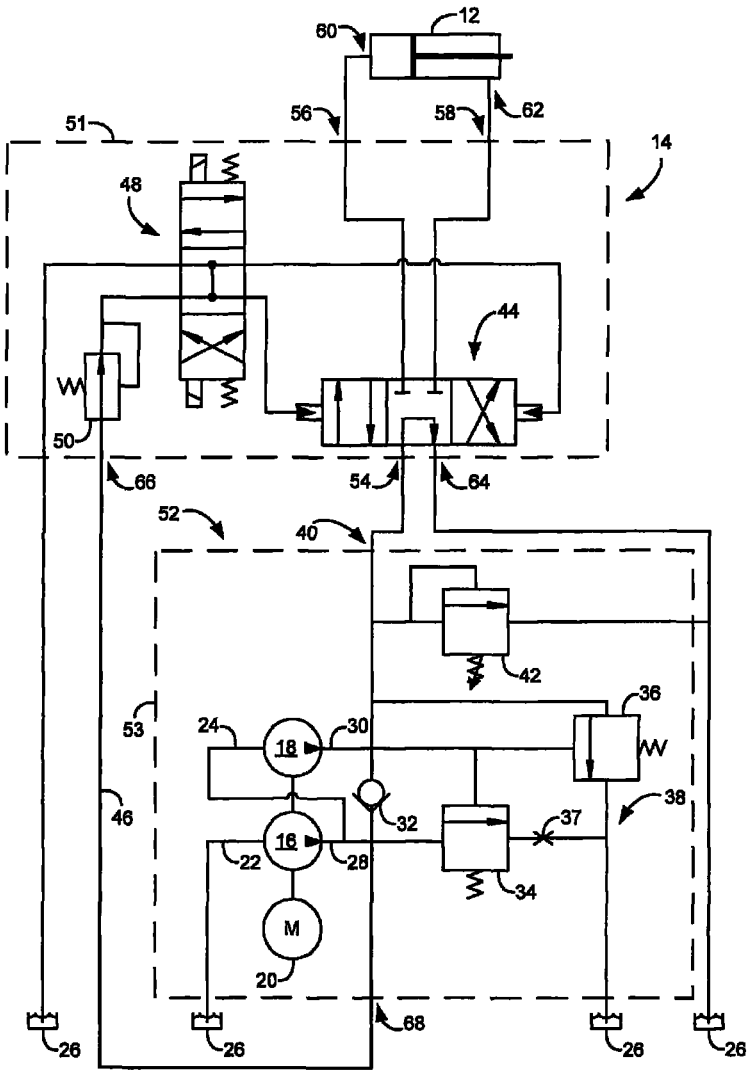
FIG. 2 is a schematic diagram of a traditional two-stage pump system retrofitted with a pilot-operated control system configured to control the delivery of hydraulic fluid from the two-stage pump system to drive an associated hydraulic tool.

The low-pressure pump 16 and the high-pressure pump 18 each include inputs 22, 24, respectively, coupled to a reservoir of hydraulic fluid 26. The low-pressure pump 16 and the high-pressure pump 18 also include outputs 28, 30, respectively, that are separated by a one-way valve 32 designed to allow flow from the output 28 of the low-pressure pump 16 toward the output 30 of the high-pressure pump 18. The low-pressure pump 16 and the high-pressure pump 18 may be arranged in parallel or in series, and the outputs of the low pressure pump 16 may pre-charge the compression chamber of the high pressure pump 18, as indicated in FIG. 2. Typically, the pumps have an inlet check valve and an outlet check valve (not shown) that only permit one-way flow through the pump.

A by-pass valve 34 is arranged at the output 28 of the low-pressure pump 16 and is biased closed to eliminate the flow of hydraulic fluid from the low-pressure pump 16 from returning back to the reservoir 26. Likewise, a relief valve 42 is arranged at the output 30 and is biased closed to eliminate the flow of hydraulic fluid from the high-pressure pump 18 from entering a relief valve passage 38 leading back to reservoir 26.

To overcome the bias of the relief valve 34 or both of the valves 34, 36, a pressure buildup must occur at an output 40 of the two-stage pump system 10 downstream of the one-way valve 32. Hence, in general, the pressure relief valves 34, 36 will be opened by a pressure buildup resulting from the operation of the low or high-pressure pumps 16, 18, which will cause the outputs 28, 30 of either the low-pressure pump 16 or both pumps 16, 18 to be released back to the reservoir 26 through the relief passage 38. The valves 34, 36 can be set to open at different pressures, with one valve 34 typically opening at a lower pressure than the other valve 36. For example, one valve 34 may open at 1,700 psi and another valve 36 may open at 10,000 psi. However, even if the valve 34 opens all of the way, a pressure of at least 200-300 psi at the output 28 will be maintained under all operating conditions due to resistance in the system. Additionally or alternatively, an orifice 37 can be used in the line 28 upstream of the tank line 38 to maintain a minimum pressure in the line 28.

Beyond the pressure relief valves 34, 36, an adjustable pressure relief valve 42 may be included. The adjustable pressure relief valve 42 includes a user-adjustable bias that enables a user to select a threshold for pressure buildup below the predetermined pressure buildup at which the pressure-relief valve 36 will open and release the output 40 back to the reservoir 26.

The pilot-operated control system 14 includes a pilot-operated valve 44. The pilot-operated valve 44 is driven by a drive line 46 connected to the output 28 of the low-pressure pump 16. In particular, the pilot-operated system 14 includes a pilot port 66 of FIG. 2 that is pressurized by a pilot pressure to actuate the pilot-operated device 44. Accordingly, the pilot pressure to actuate the pilot-operated device 44 is provided by the output 28 of the low-pressure pump 16 to control selectively driving the tool 12 from one of the output 28 of the low-pressure pump 16 and the output 30 of the high-pressure pump 18.

A user control 48 is included that serves as a user interface to control connection of the drive line 46 to one side of the pilot-operated valve 44 or the other side and; thus, allows a user to switch the tool 12 to either extend or retract. As illustrated, the user control 48 may be a solenoid-driven switch. In this case, the switch may be actuated by user intervention or may be coupled to an overall control system designed to coordinate operation of the tool 12 with additional tool systems. The cylinder 12 may be single acting or double acting, and may have a return spring or be retracted by the load if a single acting cylinder is used.

It is contemplated that a pressure-reducing valve 50 may be included in the pilot-operated control system 14. The pressure-reducing valve 50 is designed to receive hydraulic fluid from the drive line 46 and reduce the pressure of the hydraulic fluid as it is provided to the pilot ports of the pilot-operated valve 44. While not necessary in all configurations, it is desirable to include the pressure-reducing valve 50 because the output 28 of the low-pressure pump 16 may deliver hydraulic fluid at pressures as high as 1,700 psi and, in order to remain cost effective, the pilot-operated valve 44 is preferably designed to be driven by pressures of approximately 300 psi.

As illustrated in FIG. 1, it is contemplated that the pilot-operated control system 14 may be integrated with the pump system 10. On the other hand, referring now to FIG. 2, the pilot-operated control system 14 may be incorporated into a housing 51 and designed to operate as a kit configured to be retrofitted to an existing pumping system 52 enclosed in a respective housing 53.

With respect to the arrangement of the pilot-operated control system 14, the above-described components may be arranged within the housing 51. A driving-fluid inlet port 54 is included that is designed to be connected to the outlet 40 of the pumping system 52. Additionally, a driving-fluid port 56 and return port 58 are included that are designed to be connected to a port 60 and return port 62, respectively, of the tool 12. Finally, a return port 64 is included that provides a return connection to the reservoir 26. Accordingly, the pilot-operated valve 44 is positioned between the pumping system 10 and the tool 12, and can control the supply of hydraulic fluid provided to the tool 12 by the pumping system 10 and returned from the tool 12 to the reservoir 26.

A port 66 is also included in the pilot-operated control system 14 that is connected to the outlet 28 of the low-pressure pump 16 via port 68. As described above, this connection provides a portion of the low-pressure, high-volume hydraulic fluid flow delivered from the low-pressure pump 16 to the pilot-operated valve 44 to serve as the driving force for operating the pilot-operated valve 44. In this regard, in the case of a kit designed to retrofit the existing pumping system 52, the sole modification required to be made to the pumping system 52 to retrofit the pilot-operated control system 14 to the pumping system 10 is to add an additional outlet port 68 leading from the output 28 of the low-pressure pump 16. This additional outlet is then connected to the inlet port 66 of the pilot-operated control system 14 to provide driving fluid to operate the pilot-operated valve 44.

Therefore, the above-described system and method allows pilot-operated devices to be utilized in high-pressure applications. By utilizing the first-stage flow as the only hydraulic supply to power the pilot-operated device at all times, the low-volume flow from the second-stage is consistently directed to meet the requirements of the tool. Since the first stage flow is typically in the range of 6 to 20 liters per minute, an abundance of flow to power the pilot-operated device is always present. Using the above-described invention, high-pressure hydraulic controls, such as proportional relief and directional control valves, can utilize pilot-operated devices without diminished outputs at high pressures.

Furthermore, the above-described system and method are readily applicable to existing two-speed pump systems. A pressure-reducing valve arranged in a bypass circuit leading from the low-pressure pump to the pilot-operated device ensures an excess of pressure is not delivered to the pilot-operated device from the traditional low-pressure pump. Hence, the pilot-operated control system can be adapted to form a pilot-operated valve retrofit kit designed to retrofit existing pumps.

The present invention has been described in terms of the preferred embodiments, and it should be appreciated that many equivalents, alternatives, variations, and modifications, aside from those expressly stated, are possible and within the scope of the invention. Therefore, the invention should not be limited to a particular described embodiment.

I claim:

1. A two-stage, high-pressure, pumping system comprising: a low-pressure pump having an output configured to deliver a hydraulic fluid under a low-pressure at a high-volume to drive a tool associated with the two-stage, high-pressure, pumping system under low load conditions; a high-pressure pump having an output configured to deliver the hydraulic fluid under a high-pressure at a low-volume to drive the tool under high load conditions; a pilot-operated device configured to selectively drive the tool from at least one of the output of the low-pressure pump and the output of the high-pressure pump, the pilot-operated device having at least one pilot port that is pressurized by a pilot pressure to actuate the pilot-operated device; and wherein the pilot pressure to actuate the pilot-operated device is provided only by the output of the low-pressure pump to control selectively driving the tool from one of the output of the low-pressure pump and the output of the high-pressure pump.

2. The system of claim 1 further comprising an automatic control configured to control the pilot-operated device.

3. The system of claim 1 further comprising a user-control configured to control the pilot-operated device.

4. The system of claim 3 wherein the user-control includes a solenoid-driven switch.

5. The system of claim 1 further comprising a reservoir of hydraulic fluid to supply hydraulic fluid to the low-pressure pump and the high-pressure pump.

6. The system of claim 5 further comprising a one-way valve arranged between the output of the low-pressure pump and the output of the high-pressure pump to allow hydraulic fluid to flow from the output of the low-pressure pump to the tool.

7. The system of claim 5 further comprising a pressure-relief valve biased to restrict the hydraulic fluid from flowing from the output of the low-pressure pump to the reservoir of hydraulic fluid and controlled by the magnitude of the pressure at the output of the high-pressure pump.

8. The system of claim 1 further comprising a pressure reducing valve configured to reduce a pressure of the flow of hydraulic fluid from the low-pressure pump to the pilot pressure.

9. The system of claim 5 further comprising a pressure-relief valve biased to restrict the hydraulic fluid from flowing from the output of the high-pressure pump to the reservoir of hydraulic fluid and controlled by the magnitude of the pressure at the output of the high-pressure pump.

10. The system of claim 1 wherein the tool includes a hydraulic cylinder.

11. A method for operating a two-stage, high-pressure, pumping system comprising: driving a hydraulic tool under a low-load condition using a low-pressure pump having an output configured to deliver a hydraulic fluid under a low-pressure at a high-volume; driving the tool under high-load conditions using a high-pressure pump having an output configured to deliver the hydraulic fluid under a high-pressure at a low-volume; controlling a pilot-operated device using only the output of the low-pressure pump to actuate the device to selectively operate the tool.

12. A kit for retrofitting a two-stage, high-pressure, pumping system including a low-pressure pump having an output configured to deliver a hydraulic fluid under a low-pressure at a high-volume to drive a tool associated with the two-stage, high-pressure, pumping system and a high-pressure pump having an output configured to deliver the hydraulic fluid under a high-pressure at a low-volume to drive the tool, the kit comprising: a driving connection input configured to connect to the output of the low-pressure pump; a pressure reducing valve configured to receive the flow of hydraulic fluid from the driving connection input and reduce a pressure of the hydraulic fluid received from the low-pressure pump through the driving connection input; and a pilot-operated device configured to receive the flow of hydraulic fluid from the pressure reducing valve at the pressure below the low pressure, and utilize the flow of hydraulic fluid to actuate the pilot operated device so as to control the tool.

* * * * *

UNITED STATES PATENT AND TRADEMARK OFFICE

CERTIFICATE OF CORRECTION

PATENT NO. : 8,459,019 B2
APPLICATION NO. : 12/446613
DATED : June 11, 2013
INVENTOR(S) : Paul A. Hohensee It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1066 days.

Signed and Sealed this
Eighth Day of September, 2015

Michelle K. Lee

Michelle K. Lee
*Director of the United States Patent and Trademark Office*